US008899074B2

(12) United States Patent
Wilding et al.

(10) Patent No.: US 8,899,074 B2
(45) Date of Patent: Dec. 2, 2014

(54) METHODS OF NATURAL GAS LIQUEFACTION AND NATURAL GAS LIQUEFACTION PLANTS UTILIZING MULTIPLE AND VARYING GAS STREAMS

(75) Inventors: Bruce M. Wilding, Idaho Falls, ID (US); Terry D. Turner, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 1330 days.

(21) Appl. No.: 12/604,194

(22) Filed: Oct. 22, 2009

(65) Prior Publication Data

US 2011/0094263 A1 Apr. 28, 2011

(51) Int. Cl.

| | |
|---|---|
| ***F25J 1/00*** | (2006.01) |
| ***F25J 3/00*** | (2006.01) |
| ***B01D 9/04*** | (2006.01) |

(52) U.S. Cl.

USPC ..... 62/637; 62/611; 62/612; 62/613; 62/614; 62/618; 62/619; 62/532; 62/537; 62/929

(58) Field of Classification Search

CPC . F25J 2205/20; F25J 2220/40; F25J 2270/12; F25J 2270/04; F25J 2270/16; F25J 2270/18; F23J 2220/02

USPC ..... 62/611–614, 618, 619, 637, 532, 537, 62/929

See application file for complete search history.

(56) References Cited

U.S. PATENT DOCUMENTS

| | | | |
|---|---|---|---|
| 1,222,801 | A | 4/1917 | Rosenbaum |
| 2,037,679 | A | 4/1936 | Dana |
| 2,037,714 | A | 4/1936 | Gaines, Jr. |
| 2,040,059 | A | 5/1936 | Mesinger |
| 2,093,805 | A | 9/1937 | de Baufre |
| 2,157,103 | A | 5/1939 | Zenner |

(Continued)

FOREIGN PATENT DOCUMENTS

| | | | |
|---|---|---|---|
| EP | 0 676 599 | A | 10/1995 |
| EP | 1 205 721 | A1 | 5/2002 |

(Continued)

OTHER PUBLICATIONS

Bodner Research Web, "Phase Diagrams," http://chemed.chem.purdue.edu/genchem/topicreview/bp/ch14/phase.php.

(Continued)

*Primary Examiner* — Frantz Jules

*Assistant Examiner* — Erik Mendoza-Wilkenfel

(74) *Attorney, Agent, or Firm* — TraskBritt

(57) ABSTRACT

A method of natural gas liquefaction may include cooling a gaseous NG process stream to form a liquid NG process stream. The method may further include directing the first tail gas stream out of a plant at a first pressure and directing a second tail gas stream out of the plant at a second pressure. An additional method of natural gas liquefaction may include separating $CO_2$ from a liquid NG process stream and processing the $CO_2$ to provide a $CO_2$ product stream. Another method of natural gas liquefaction may include combining a marginal gaseous NG process stream with a secondary substantially pure NG stream to provide an improved gaseous NG process stream. Additionally, a NG liquefaction plant may include a first tail gas outlet, and at least a second tail gas outlet, the at least a second tail gas outlet separate from the first tail gas outlet.

18 Claims, 2 Drawing Sheets

(56) References Cited

U.S. PATENT DOCUMENTS 2,209,534 A 7/1940 Moore
2,494,120 A 10/1950 Ferro, Jr.
2,669,941 A 2/1954 Stafford
2,701,641 A 2/1955 Krijgsman
2,858,020 A 10/1958 Bek
2,900,797 A 8/1959 Kurata et al.
2,937,503 A 5/1960 Swearingen et al.
3,132,016 A 5/1964 Kurata
3,168,136 A 2/1965 Ammon
3,182,461 A 5/1965 Johanson
3,193,468 A 7/1965 Sprague
3,213,631 A 10/1965 Kniel
3,218,816 A 11/1965 Grenier
3,236,057 A 2/1966 Hashemi-Tafreshi
3,254,496 A 6/1966 Roche et al.
3,289,756 A 12/1966 Jaeger
3,292,380 A 12/1966 Bucklin
3,312,073 A 4/1967 Jackson et al.
3,315,475 A 4/1967 Harmens
3,323,315 A 6/1967 Carr
3,326,453 A 6/1967 Kun
3,349,020 A 10/1967 Crownover et al.
3,362,173 A 1/1968 Kneil
3,376,709 A 4/1968 Dickey et al.
3,406,496 A 10/1968 Betteridge et al.
3,407,052 A 10/1968 Huntress et al.
3,416,324 A 12/1968 Swearingen
3,422,887 A 1/1969 Berkeley
3,448,587 A 6/1969 Goard et al.
3,487,652 A 1/1970 McKay
3,503,220 A 3/1970 Desai
3,516,262 A 6/1970 Bernstein
3,548,606 A 12/1970 Kuerston
3,596,473 A 8/1971 Streich
3,608,323 A 9/1971 Salama
3,616,652 A 11/1971 Engel
3,628,340 A 12/1971 Meisler et al.
3,677,019 A 7/1972 Olszewski
3,690,114 A * 9/1972 Swearingen et al. ..... 62/613
3,724,225 A * 4/1973 Mancini et al. ..... 62/637
3,724,226 A 4/1973 Pachaly
3,735,600 A 5/1973 Dowdell et al.
3,846,993 A 11/1974 Bates
3,886,885 A 6/1975 Becker et al.
3,897,226 A 7/1975 Doherty
4,001,116 A 1/1977 Selcukoglu
4,004,430 A 1/1977 Solomon et al.
4,007,601 A 2/1977 Webbon
4,022,597 A 5/1977 Bacon
4,025,315 A 5/1977 Mazelli
4,032,337 A 6/1977 Boyer
4,120,911 A 10/1978 Davidson
4,128,410 A 12/1978 Bacon
4,148,723 A 4/1979 Mozley
4,161,107 A 7/1979 Korsakov-Bogatkov et al.
4,183,369 A 1/1980 Thomas
4,187,689 A 2/1980 Selcukoglu et al.
4,224,902 A 9/1980 Binder et al.
4,294,274 A 10/1981 LeRoy
4,318,723 A * 3/1982 Holmes et al. ..... 62/632
4,334,902 A 6/1982 Paradowski
4,359,871 A 11/1982 Strass
4,370,150 A 1/1983 Fenstermaker
4,453,956 A 6/1984 Fabbri et al.
4,479,533 A 10/1984 Persson et al.
4,479,536 A 10/1984 Lameris
4,522,636 A 6/1985 Markbreiter et al.
4,528,006 A 7/1985 Vitovec et al.
4,561,496 A 12/1985 Kehrer
4,609,390 A 9/1986 Wilson
4,611,655 A 9/1986 Molignoni
4,645,522 A 2/1987 Dobrotwir
4,654,522 A 3/1987 Gornick et al.
4,783,272 A 11/1988 Patterson
4,798,242 A 1/1989 Kito et al.
4,822,393 A 4/1989 Markbreiter et al.
4,846,862 A 7/1989 Cook
4,869,313 A 9/1989 Fredley
4,970,867 A 11/1990 Herron et al.
4,993,485 A 2/1991 Gorman
4,994,097 A 2/1991 Brouwers
5,003,782 A 4/1991 Kucerija
5,032,143 A 7/1991 Ritakallio
5,036,671 A 8/1991 Nelson et al.
5,062,270 A 11/1991 Haut et al.
5,074,758 A 12/1991 McIntyre
5,174,796 A 12/1992 Davis et al.
5,218,832 A 6/1993 Woolley
5,252,613 A 10/1993 Chang et al.
5,291,736 A 3/1994 Paradowski
5,325,673 A 7/1994 Durr et al.
5,327,730 A 7/1994 Myers et al.
5,375,422 A 12/1994 Butts
5,379,832 A 1/1995 Dempsey
5,386,699 A 2/1995 Myers et al.
5,390,499 A 2/1995 Rhoades et al.
5,419,392 A 5/1995 Maruyama
5,450,728 A 9/1995 Vora et al.
5,473,900 A 12/1995 Low
5,489,725 A 2/1996 Minkkinen et al.
5,505,048 A 4/1996 Ha et al.
5,505,232 A 4/1996 Barclay
5,511,382 A 4/1996 Denis et al.
5,537,827 A 7/1996 Low et al.
5,551,256 A 9/1996 Schmidt
5,600,969 A 2/1997 Low
5,615,561 A 4/1997 Houshmand et al.
5,615,738 A 4/1997 Cameron et al.
5,655,388 A 8/1997 Bonaquist et al.
5,669,234 A 9/1997 Houser et al.
5,704,227 A 1/1998 Krabbendam
5,718,126 A 2/1998 Capron et al.
5,755,114 A 5/1998 Foglietta
5,755,280 A 5/1998 Da Costa et al.
5,799,505 A 9/1998 Bonaquist et al.
5,819,555 A 10/1998 Engdahl
5,836,173 A 11/1998 Lynch et al.
5,916,260 A 6/1999 Dubar
5,950,453 A 9/1999 Bowen et al.
5,956,971 A 9/1999 Cole et al.
5,983,665 A 11/1999 Howard et al.
6,023,944 A 2/2000 Blundell
6,041,620 A 3/2000 Olszewski et al.
6,085,546 A 7/2000 Johnston
6,085,547 A 7/2000 Johnston
6,105,390 A 8/2000 Bingham et al.
6,131,395 A 10/2000 Greene et al.
6,131,407 A 10/2000 Wissolik
6,138,473 A 10/2000 Boyer-Vidal
6,138,746 A 10/2000 Livolsi et al.
6,196,021 B1 3/2001 Wissolik
6,200,536 B1 3/2001 Tonkovich et al.
6,212,891 B1 4/2001 Minta et al.
6,220,052 B1 4/2001 Tate, Jr. et al.
6,220,053 B1 4/2001 Hass et al.
6,250,244 B1 6/2001 Dubar et al.
6,301,927 B1 10/2001 Reddy
6,354,105 B1 3/2002 Lee et al.
6,367,286 B1 4/2002 Price
6,370,910 B1 4/2002 Grootjans et al.
6,372,019 B1 4/2002 Alferov et al.
6,375,906 B1 4/2002 Edlund et al.
6,378,330 B1 4/2002 Minta et al.
6,382,310 B1 5/2002 Smith
6,389,844 B1 5/2002 Klein Nagel Voort
6,390,114 B1 5/2002 Haandrikman et al.
6,397,936 B1 6/2002 Crowley et al.
6,400,896 B1 6/2002 Longardner
6,410,087 B1 6/2002 Wilde et al.
6,412,302 B1 7/2002 Foglietta
6,425,263 B1 7/2002 Bingham et al.
6,427,464 B1 8/2002 Beaverson et al.
6,442,969 B1 9/2002 Rojey et al.
6,484,533 B1 11/2002 Allam et al.

(56) References Cited

U.S. PATENT DOCUMENTS

| | | | | |
|---|---|---|---|---|
| 6,581,409 | B2 | 6/2003 | Wilding et al. | |
| 6,581,510 | B2 | 6/2003 | Koch et al. | |
| 6,694,774 | B1 | 2/2004 | Rashad et al. | |
| 6,722,399 | B1 | 4/2004 | Cano | |
| 6,742,358 | B2 | 6/2004 | Wilkinson et al. | |
| 6,767,388 | B2 | 7/2004 | Lecomte et al. | |
| 6,962,061 | B2 | 11/2005 | Wilding et al. | |
| 7,219,512 | B1 | 5/2007 | Wilding et al. | |
| 7,228,714 | B2 | 6/2007 | Howard | |
| 7,325,415 | B2 | 2/2008 | Amin et al. | |
| 7,469,556 | B2 | 12/2008 | Howard | |
| 7,575,624 | B2 | 8/2009 | Cartwright et al. | |
| 7,591,150 | B2 | 9/2009 | Turner et al. | |
| 7,594,414 | B2 | 9/2009 | Wilding et al. | |
| 7,765,920 | B2 | 8/2010 | Keller | |
| 2003/0196452 | A1* | 10/2003 | Wilding et al. | 62/613 |
| 2004/0083888 | A1 | 5/2004 | Qualls | |
| 2004/0105812 | A1 | 6/2004 | Tonkovich et al. | |
| 2004/0148962 | A1 | 8/2004 | Rashad et al. | |
| 2004/0177646 | A1 | 9/2004 | Wilkinson et al. | |
| 2005/0144979 | A1 | 7/2005 | Zollinger et al. | |
| 2005/0183452 | A1 | 8/2005 | Hahn et al. | |
| 2005/0220704 | A1 | 10/2005 | Morrow et al. | |
| 2005/0279132 | A1 | 12/2005 | Eaton et al. | |
| 2006/0053806 | A1 | 3/2006 | Tassel | |
| 2006/0213222 | A1 | 9/2006 | Whitesell | |
| 2006/0213223 | A1* | 9/2006 | Wilding et al. | 62/613 |
| 2007/0017250 | A1 | 1/2007 | Turner et al. | |
| 2007/0107465 | A1* | 5/2007 | Turner et al. | 62/613 |
| 2007/0137246 | A1* | 6/2007 | McKellar et al. | 62/620 |
| 2007/0193303 | A1 | 8/2007 | Hawrysz et al. | |
| 2008/0148770 | A1* | 6/2008 | Migliore et al. | 62/612 |
| 2008/0156035 | A1 | 7/2008 | Aspelund et al. | |
| 2009/0071634 | A1 | 3/2009 | Turner et al. | |
| 2009/0277217 | A1* | 11/2009 | Ransbarger et al. | 62/612 |
| 2010/0018248 | A1 | 1/2010 | Fieler et al. | |
| 2010/0088920 | A1 | 4/2010 | LaRou | |
| 2010/0186446 | A1 | 7/2010 | Turner et al. | |
| 2010/0223950 | A1* | 9/2010 | Malsam | 62/611 |
| 2010/0313597 | A1* | 12/2010 | Bridgwood | 62/612 |
| 2010/0326533 | A1* | 12/2010 | Mooney et al. | 137/12 |
| 2012/0103012 | A1 | 5/2012 | Turner et al. | |
| 2012/0103428 | A1 | 5/2012 | Turner et al. | |
| 2012/0103561 | A1 | 5/2012 | Turner et al. | |

FOREIGN PATENT DOCUMENTS

| | | | |
|---|---|---|---|
| JP | 58-159830 | | 9/1983 |
| JP | 11200817 | A | 7/1999 |
| JP | 2002071861 | A | 3/2002 |
| WO | 88/00936 | | 2/1988 |
| WO | 98/59206 | | 12/1998 |
| WO | 03/062725 | A | 7/2003 |
| WO | 2010023238 | A1 | 3/2010 |

OTHER PUBLICATIONS

Search Report for PCT/US2006/041039 dated Aug. 8, 2007.
Search Report for PCT/US2007/084677 dated Jul. 1, 2008.
International Preliminary Report for PCT/US08/68938 dated Mar. 16, 2010.
Search Report for PCT/US20101045340 dated Oct. 13, 2010.
Search Report for PCT/US20101045332 dated Oct. 18, 2010.
Search Report for PCT/US2008/051012 dated May 20, 2008.
Search Report for PCT/US2010/045321 dated Oct. 1, 2010.
International Preliminary Examination Report for PCT/US2002/20924 dated Jun. 17, 2003.
Search Report for PCT/US1998/027232, dated Jul. 7, 1999.
U.S. Appl. No. 12/603,948, filed Oct. 22, 2009, titled, "Complete Liquefaction Methods and Apparatus," by Turner et al.
U.S. Appl. No. 12/604,139, filed Oct. 22, 2009, titled, "Natural Gas Liquefaction Core Modules, Plants Including Same and Related Methods," by Wilding et al.
PCT International Preliminary Report on Patentability and Written Opinion for PCT/US2010/045321 dated Oct. 1, 2010, 6 pages.
"A National Vision of America's Transition to a Hydrogen Economy—To 2030 and Beyond," Based on the results of the National Hydrogen Vision Meeting Washington, DC Nov. 15-16, 2001, United States Department of Energy.
Curtin University of Technology, LNG Microcell Progress Update, May 2002, Curtin/Corelab.
"Generation of Hydrogen and Transportation and Transmission of Energy Generated on the U.S. Outer Continental Shelf to Onshore," (Minerals Management Service), May 2006.
Holmes et al., "Ryan/Holmes Cryogenic Acid Gas/Hydrocarbon Separations Provide Economic Benefits for LNG Production," 7th International Conference on Liquefied Natural Gas; Jakarta, Indonesia; May 1983; Institute of Gas Technology, Session II, vol. 1, pp. 1-15.
"Hydrogen as an Energy Carrier and its Production by Nuclear Power," IAEA-TECDOC-1085, International Atomic Energy Agency, May 1999.
"Hydrogen Infrastructure Delivery, Reliability R&D Needs," Science Applications International Corporation, Prepared for U.S. Department of Energy, NETL Natural Gas & Infrastructure Reliability Program <www.netl.doe.gov/technologies/oil-gas/publications/td/Final%20White%20Paper%20072604.pdf>.
International Search Report dated Sep. 17, 2002 (4 pages).
Mott Corporation, "Porous metal solutions," Jun. 2007, 16 pages.
"Porous Metal Design Guidebook," Metal Powder Industries Federation, Princeton, NJ, <<http://www.mpif.org/designcenter/porous.pdf>>, Jun. 2007, 25 pages.
"The Hydrogen Economy: Opportunities, Costs, Barriers, and R&D Needs," National Academy of Engineering and Board on Energy and Environmental Systems, 2004, The National Academies Press, <http://books.nap.edu/books/0309091632/html/index.html>.
"The Hydrogen Initiative, Panel on Public Affairs," American Physical Society, Mar. 2004, <http://www.aps.org/public_affairs/popa/reports/index.cfm>.
PCT International Preliminary Report on Patentability and Written Opinion for PCT/US2006/041039 dated Apr. 9, 2009, 7 pages.
PCT International Preliminary Report on Patentability and Written Opinion for PCT/US2007/084677 dated May 28, 2009, 7 pages.
PCT International Search Report and Written Opinion for PCT/US08/68938 dated Oct. 10, 2008, 8 pages.
PCT International Preliminary Report on Patentability and Written Opinion for PCT/US2008/051012 dated Aug. 27, 2009, 7 pages.
PCT International Preliminary Report on Patentability and Written Opinion for PCT/US2010/045332 dated Oct. 18, 2010, 11 pages.
U.S. Appl. No. 13/528,246, filed Jun. 20, 2012, titled "Natural Gas Liquefaction Employing Independent Refrigerant Path," by Turner et al.

* cited by examiner

METHODS OF NATURAL GAS LIQUEFACTION AND NATURAL GAS LIQUEFACTION PLANTS UTILIZING MULTIPLE AND VARYING GAS STREAMS

GOVERNMENT RIGHTS

This invention was made with government support under Contract Number DE-AC07-05ID14517 awarded by the United States Department of Energy. The government has certain rights in the invention.

CROSS-REFERENCE TO RELATED APPLICATIONS

This application is related to U.S. patent application Ser. No. 09/643,420, filed Aug. 23, 2001, for APPARATUS AND PROCESS FOR THE REFRIGERATION, LIQUEFACTION AND SEPARATION OF GASES WITH VARYING LEVELS OF PURITY, now U.S. Pat. No. 6,425,263, issued Jul. 30, 2002, which is a continuation of U.S. patent application Ser. No. 09/212,490, filed Dec. 16, 1998, for APPARATUS AND PROCESS FOR THE REFRIGERATION, LIQUEFACTION AND SEPARATION OF GASES WITH VARYING LEVELS OF PURITY, now U.S. Pat. No. 6,105,390, issued Aug. 22, 2000, which claims the benefit of U.S. Provisional Patent Application Ser. No. 60/069,698 filed Dec. 16, 1997. This application is also related to U.S. patent application Ser. No. 11/381,904, filed May 5, 2006, for APPARATUS FOR THE LIQUEFACTION OF NATURAL GAS AND METHODS RELATING TO SAME, now U.S. Pat. No. 7,594,414, issued Sep. 29, 2009; U.S. patent application Ser. No. 11/383,411, filed May 15, 2006, for APPARATUS FOR THE LIQUEFACTION OF NATURAL GAS AND METHODS RELATING TO SAME, now U.S. Pat. No. 7,591,150, issued Sep. 22, 2009; U.S. patent application Ser. No. 11/560,682, filed Nov. 16, 2006, for APPARATUS FOR THE LIQUEFACTION OF GAS AND METHODS RELATING TO SAME; U.S. patent application Ser. No. 11/536,477, filed Sep. 28, 2006, for APPARATUS FOR THE LIQUEFACTION OF A GAS AND METHODS RELATING TO SAME, now U.S. Pat. No. 7,637,122, issued Dec. 29, 2009; U.S. patent application Ser. No. 11/674,984, filed Feb. 14, 2007, for SYSTEMS AND METHODS FOR DELIVERING HYDROGEN AND SEPARATION OF HYDROGEN FROM A CARRIER MEDIUM, now abandoned, which is a continuation-in-part of U.S. patent application Ser. No. 11/124,589, filed May 5, 2005, for APPARATUS FOR THE LIQUEFACTION OF NATURAL GAS AND METHODS RELATING TO SAME, now U.S. Pat. No. 7,219,512, issued May 22, 2007, which is a continuation of U.S. patent application Ser. No. 10/414,991, filed Apr. 14, 2003, for APPARATUS FOR THE LIQUEFACTION OF NATURAL GAS AND METHODS RELATING TO SAME, now U.S. Pat. No. 6,962,061, issued Nov. 8, 2005, and U.S. patent application Ser. No. 10/414,883, filed Apr. 14, 2003, for APPARATUS FOR THE LIQUEFACTION OF NATURAL GAS AND METHODS RELATING TO SAME, now U.S. Pat. No. 6,886,362, issued May 3, 2005, which is a divisional of U.S. patent application Ser. No. 10/086,066, filed Feb. 27, 2002, for APPARATUS FOR THE LIQUEFACTION OF NATURAL GAS AND METHODS RELATED TO SAME, now U.S. Pat. No. 6,581,409, issued Jun. 24, 2003, and which claims the benefit of U.S. Provisional Patent Application Ser. No. 60/288,985, filed May 4, 2001, for SMALL SCALE NATURAL GAS LIQUEFACTION PLANT. This application is also related to U.S. patent application Ser. No. 11/855,071, filed Sep. 13, 2007, for HEAT EXCHANGER AND ASSOCIATED METHODS, now U.S. Pat. No. 8,061,413, issued Nov. 22, 2011; U.S. patent application Ser. No. 12/603,948, filed Oct. 22, 2009, for COMPLETE LIQUEFACTION METHODS AND APPARATUS, now U.S. Pat. 8,555,672, issued Oct. 15, 2013; and U.S. patent application Ser. No. 12/604,139, filed Oct. 22, 2009, for NATURAL GAS LIQUEFACTION CORE MODULES, PLANTS INCLUDING SAME AND RELATED METHODS. The disclosure of each of the foregoing documents is incorporated by reference herein in its entirety. This application is also related to U.S. patent application Ser. No. 12/648,659, filed Dec. 29, 2009, for METHODS AND APPARATUS FOR FORMING AND SEPARATING A SLURRY OF LNG AND SOLID CARBON DIOXIDE, which is a continuation of U.S. patent application Ser. No. 11/536,477, filed Sep. 28, 2006, for APPARATUS FOR THE LIQUEFACTION OF A GAS AND METHODS RELATING TO SAME, now U.S. Pat. No. 7,637,122, issued Dec. 29, 2009; U.S. patent application Ser. No. 12/938,761, filed Nov. 3, 2010, for VAPORIZATION CHAMBERS AND ASSOCIATED METHODS; U.S. patent application Ser. No. 12/938,826, filed Nov. 3, 2010, for HEAT EXCHANGER AND RELATED METHODS; U.S. patent application Ser. No. 12/938,967, filed Nov. 3, 2010, for SUBLIMATION SYSTEMS AND ASSOCIATED METHODS; U.S. patent application Ser. No. 13/284,737, filed Oct. 28, 2011, for METHODS OF CONVEYING FLUIDS AND METHODS OF SUBLIMATING SOLID PARTICLES, now U.S. Pat. No. 8,544,295, issued Oct. 1, 2013, which is a divisional of U.S. patent application Ser. No. 11/855,071, filed Sep. 13, 2007, for HEAT EXCHANGERS COMPRISING AT LEAST ONE POROUS MEMBER POSITIONED WITHIN A CASING, now U.S. Pat. No. 8,061,413, issued Nov. 22, 2011; and U.S. patent application Ser. No. 13/528,246, filed Jun. 20, 2012, for NATURAL GAS LIQUEFACTION EMPLOYING INDEPENDENT REFRIGERANT PATH.

TECHNICAL FIELD

The present invention relates generally to the compression and liquefaction of gases and, more particularly, to methods and apparatus for the partial liquefaction of a gas, such as natural gas, by utilizing a combined refrigerant and expansion process with multiple tail gas streams.

BACKGROUND

Natural gas is a known alternative to combustion fuels such as gasoline and diesel. Much effort has gone into the development of natural gas as an alternative combustion fuel in order to combat various drawbacks of gasoline and diesel including production costs and the subsequent emissions created by the use thereof. As is known in the art, natural gas is a cleaner burning fuel than other combustion fuels. Additionally, natural gas is considered to be safer than gasoline or diesel as natural gas will rise in the air and dissipate, rather than settling.

To be used as an alternative combustion fuel, natural gas (also termed "feed gas" herein) is conventionally converted into compressed natural gas (CNG) or liquified (or liquid) natural gas (LNG) for purposes of storing and transporting the fuel prior to its use. Conventionally, two of the known basic cycles for the liquefaction of natural gases are referred to as the "cascade cycle" and the "expansion cycle."

Briefly, the cascade cycle consists of a series of heat exchanges with the feed gas, each exchange being at successively lower temperatures until liquefaction is accomplished. The levels of refrigeration are obtained with different refrigerants or with the same refrigerant at different evaporating pressures. The cascade cycle is considered to be very efficient at producing LNG as operating costs are relatively low. However, the efficiency in operation is often seen to be offset by the relatively high investment costs associated with the expensive heat exchange and the compression equipment associated with the refrigerant system. Additionally, a liquefaction plant incorporating such a system may be impractical where physical space is limited, as the physical components used in cascading systems are relatively large.

In an expansion cycle, gas is conventionally compressed to a selected pressure, cooled, and then allowed to expand through an expansion turbine, thereby producing work as well as reducing the temperature of the feed gas. The low temperature feed gas is then heat exchanged to effect liquefaction of the feed gas. Conventionally, such a cycle has been seen as being impracticable in the liquefaction of natural gas since there is no provision for handling some of the components present in natural gas, which freeze at the temperatures encountered in the heat exchangers, for example, water and carbon dioxide.

Additionally, to make the operation of conventional systems cost effective, such systems are conventionally built on a large scale to handle large volumes of natural gas. As a result, fewer facilities are built, making it more difficult to provide the raw gas to the liquefaction plant or facility as well as making distribution of the liquefied product an issue. Another major problem with large-scale facilities is the capital and operating expenses associated therewith. For example, a conventional large-scale liquefaction plant, i.e., producing on the order of 70,000 gallons of LNG per day, may cost $16.3 million to $24.5 million, or more, in capital expenses.

An additional problem with large facilities is the cost associated with storing large amounts of fuel in anticipation of future use and/or transportation. Not only is there a cost associated with building large storage facilities, but there is also an efficiency issue related therewith as stored LNG will tend to warm and vaporize over time creating a loss of the LNG fuel product. Further, safety may become an issue when larger amounts of LNG fuel product are stored.

In confronting the foregoing issues, various systems have been devised that attempt to produce LNG or CNG from feed gas on a smaller scale, in an effort to eliminate long-term storage issues and to reduce the capital and operating expenses associated with the liquefaction and/or compression of natural gas.

For example, small scale LNG plants have been devised to produce LNG at a pressure letdown station, wherein gas from a relatively high pressure transmission line is utilized to produce LNG and tail gases from the liquefaction process are directed into a single lower pressure downstream transmission line. However, such plants may only be suitable for pressure let down stations having a relatively high pressure difference between upstream and downstream transmission lines, or may be inefficient at pressure let down stations having relatively low pressure drops. In view of this, the production of LNG at certain existing let down stations may be impractical using existing LNG plants.

Additionally, since many sources of natural gas, such as residential or industrial service gas, are considered to be relatively "dirty," the requirement of providing "clean" or "pre-purified" gas is actually a requirement of implementing expensive and often complex filtration and purification systems prior to the liquefaction process. This requirement simply adds expense and complexity to the construction and operation of such liquefaction plants or facilities.

In view of the foregoing, it would be advantageous to provide a method, and a plant for carrying out such a method, which is flexible and has improved efficiency in producing liquefied natural gas. Additionally, it would be advantageous to provide a more efficient method for producing liquefied natural gas from a source of relatively "dirty" or "unpurified" natural gas without the need for "pre-purification."

It would be desirable to develop new liquefaction methods and plants that take advantage of pressure let down locations that may have multiple transmission lines carrying natural gas at varied pressures, and pressure let down stations having relatively low pressure drops. Additionally, it would be desirable to develop new liquefaction methods and plants that enable more efficient use of various tail gases generated during liquefaction. The flexibility of such a design would also make it applicable to be used as a modular design for optimal implementation of small scale liquefaction plants in a variety of different locations.

It would be additionally advantageous to provide a plant for the liquefaction of natural gas which is relatively inexpensive to build and operate, and which desirably requires little or no operator oversight.

It would be additionally advantageous to provide such a plant which is relatively easily transportable and which may be located and operated at existing sources of natural gas which are within or near populated communities, thus providing easy access for consumers of LNG fuel.

BRIEF SUMMARY

In one embodiment, a method of natural gas liquefaction may include directing a gaseous natural gas (NG) process stream and a cooling stream into a plant, cooling the gaseous NG process stream by transferring heat from the gaseous NG process stream to the cooling stream, and expanding the cooled gaseous NG process stream to form a liquid NG process stream and a first tail stream comprising a gaseous NG. The method may further include directing the first tail gas stream out of the plant at a first pressure, separating a secondary liquid NG stream from the liquid NG process stream and vaporizing at the secondary liquid NG stream with a heat exchanger to form a tail stream comprising gaseous NG. Additionally, the second tail gas stream may be directed out of the plant at a second pressure, the second pressure different than the first pressure of the first tail gas stream.

In another embodiment, a method of natural gas liquefaction may include directing a gaseous natural gas (NG) process stream comprising gaseous carbon dioxide ($CO_2$) into a plant, cooling the gaseous NG process stream within a heat exchanger, and expanding the cooled gaseous NG process stream to form a liquid NG process stream comprising solid $CO_2$. The method may further include directing a substantially pure liquid NG into a storage tank. Additionally, the method may include separating the $CO_2$ from the liquid NG process stream and processing the $CO_2$ to provide a $CO_2$ product stream.

In an additional embodiment, a method of natural gas liquefaction may include directing a marginal gaseous natural gas (NG) process stream comprising at least one impurity into a plant and combining the marginal gaseous NG process stream with a secondary substantially pure NG stream to provide an improved gaseous NG process stream. The method may further include cooling the improved gaseous NG process stream within a heat exchanger, expanding the cooled improved gaseous NG process stream to form a liquid natural gas (LNG) process stream, and separating the at least one impurity from the LNG process stream to provide a substantially pure LNG process stream. Additionally, the method may include providing the secondary substantially pure NG stream from the substantially pure LNG process stream.

In a further embodiment, a natural gas liquefaction plant may include a gaseous natural gas process stream inlet, a multi-pass heat exchanger comprising a first channel configured to cool a gaseous natural gas process stream and an expander valve configured to cool at least a portion of the gaseous natural gas process stream to a liquid state. The natural gas liquefaction plant may further include a liquid natural gas outlet, a first tail gas outlet, and at least a second tail gas outlet, the at least a second tail gas outlet separate from the first tail gas outlet.

BRIEF DESCRIPTION OF THE SEVERAL VIEWS OF THE DRAWINGS

The foregoing and other advantages of the invention will become apparent upon reading the following detailed description and upon reference to the drawings.

DETAILED DESCRIPTION

Figure 1:
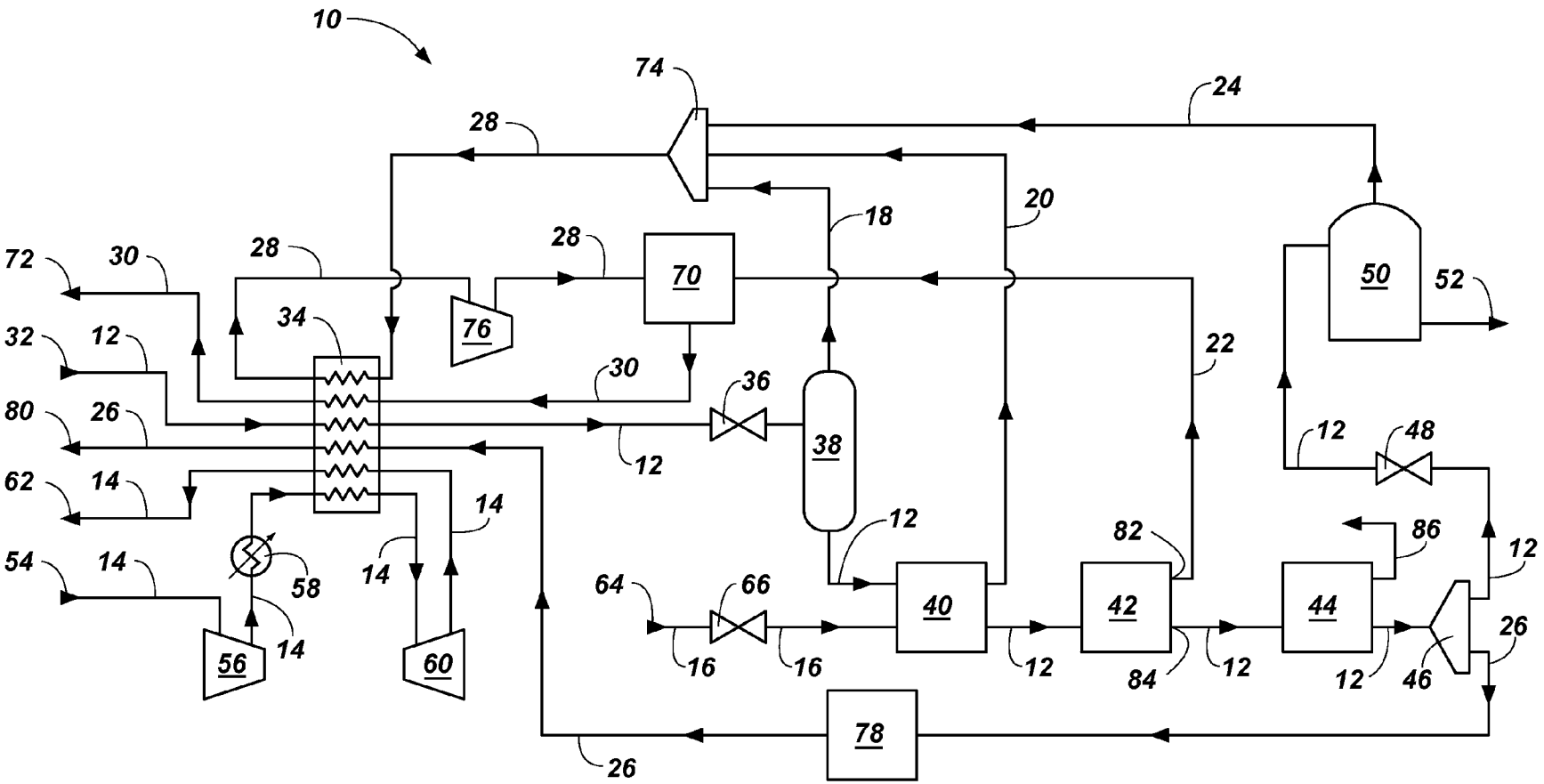
FIG. 1 is a schematic overview of a liquefaction plant according to an embodiment of the present invention.

Illustrated in FIG. 1 is a schematic overview of a natural gas (NG) liquefaction plant 10 of an embodiment of the present invention. The plant 10 includes a process stream 12, a cooling stream 14, a transfer motive gas stream 16 and tail gas streams 26, 30. A shown in FIG. 1, the process stream 12 may be directed through a NG inlet 32, a primary heat exchanger 34 and an expansion valve 36. The process stream 12 may then be directed though a gas-liquid separation tank 38, a transfer tank 40, a hydrocyclone 42 and a filter 44. Finally, the process stream 12 may be directed through a splitter 46, a valve 48, a storage tank 50 and a liquid natural gas (LNG) outlet 52.

As further shown in FIG. 1, the cooling stream 14 may be directed through a cooling fluid inlet 54, a turbo compressor 56, an ambient heat exchanger 58, the primary heat exchanger 34, a turbo expander 60, and finally, through a cooling fluid outlet 62. Additionally, the transfer motive gas stream 16 may be directed through a transfer fluid inlet 64, a valve 66 and the transfer tank 40. Optionally, the transfer motive gas stream 16 may also be directed through the primary heat exchanger 34.

A first tail gas stream 30 may include a combination of streams from the plant 10. For example, as shown in FIG. 1, the first tail gas stream 30 may include a carbon dioxide management stream 22, a separation chamber vent stream 18, a transfer tank vent stream 20, and a storage tank vent stream 24. The carbon dioxide management stream 22 may be directed from an underflow outlet 68 of the hydrocyclone 42, and then may be directed through a sublimation chamber 70, the primary heat exchanger 34 and a first tail gas outlet 72. Additionally, the separation chamber vent stream 18 may be directed from a gas outlet of the gas liquid separation tank 38, the transfer tank vent stream 20 may be directed from the transfer tank 40, and a storage tank vent stream 24 may be directed from the storage tank 50. The separation chamber vent stream 18, the transfer tank vent stream 20, and the storage tank vent stream 24 may then be directed through a mixer 74, the heat exchanger 34, and a compressor 76.

Finally, as shown in FIG. 1, a second tail gas stream 26 may be directed from an outlet of the splitter 46. The second tail gas stream 26 may then be directed through a pump 78, the heat exchanger 34, and finally, through a second tail gas outlet 80.

In operation, the cooling stream 14 may be directed into the plant 10 in a gaseous phase through the cooling fluid inlet 54 and then directed into the turbo compressor 56 to be compressed. The compressed cooling stream 14 may then exit the turbo compressor 56 and be directed into the ambient heat exchanger 58, which may transfer heat from the cooling stream 14 to ambient air. Additionally, the cooling stream 14 may be directed through a first channel of the primary heat exchanger 34, where it may be further cooled.

In some embodiments, the primary heat exchanger 34 may comprise a high performance aluminum multi-pass plate and fin type heat exchanger, such as may be purchased from Chart Industries Inc., 1 Infinity Corporate Centre Drive, Suite 300, Garfield, Heights, Ohio 44125, or other well-known manufacturers of such equipment.

After passing through the primary heat exchanger 34, the cooling stream 14 may be expanded and cooled in the turbo expander 60. For example, the turbo expander 60 may comprise a turbo expander having a specific design for a mass flow rate, pressure level of gas, and temperature of gas to the inlet, such as may be purchased from GE Oil and Gas, 1333 West Loop South, Houston, Tex. 77027-9116, USA, or other well-known manufacturers of such equipment. Additionally, the energy required to drive the turbo compressor 56 may be provided by the turbo expander 60, such as by the turbo expander 60 being directly connected to the turbo compressor 56 or by the turbo expander 60 driving an electrical generator (not shown) to produce electrical energy to drive an electrical motor (not shown) that may be connected to the turbo compressor 56. The cooled cooling stream 14 may then be directed through a second channel of the primary heat exchanger 34 and then exit the plant 10 via the cooling fluid outlet 62.

Meanwhile, a gaseous NG may be directed into the NG inlet 32 to provide the process stream 12 to the plant 10 and the process stream 12 may then be directed through a third channel of the primary heat exchanger 34. Heat from the process stream 12 may be transferred to the cooling stream 14 within the primary heat exchanger 34 and the process stream 12 may exit the primary heat exchanger 34 in a cooled gaseous state. The process stream 12 may then be directed through the expansion valve 36, such as a Joule-Thomson expansion valve, wherein the process stream 12 may be expanded and cooled to form a liquid natural gas (LNG) portion and a gaseous NG portion. Additionally, carbon dioxide ($CO_2$) that may be contained within the process stream 12 may become solidified and suspended within the LNG portion, as carbon dioxide has a higher freezing temperature than methane ($CH_4$), which is the primary component of NG. The LNG portion and the gaseous portion may be directed into the gas-liquid separation tank 38, and the LNG portion may be directed out of the separation tank 38 as a LNG process stream 12, which may then be directed into the transfer tank 40. A transfer motive gas stream 16, such as a gaseous NG, may then be directed into the plant 10 through the transfer motive gas inlet 64 through the valve 66, which may be utilized to regulate the pressure of the transfer motive gas stream 16 prior to being directed into the transfer tank 40. The transfer motive gas stream 16 may facilitate the transfer of the liquid NG process stream 12 through the hydrocyclone 42, such as may be available, for example, from Krebs Engineering of Tucson, Ariz., wherein the solid $CO_2$ may be separated from the liquid NG process stream 12. For example, the transfer motive gas stream 16 may be utilized to pressurize the liquid of the process stream 12 to move the process stream 12 through the hydrocyclone 42.

Optionally, a separate transfer tank 40 may not be used and instead a portion of the separation tank 38 may be utilized as a transfer tank or a pump may be utilized to transfer the process stream 12 into the hydrocyclone 42. In additional embodiments, a pump may be utilized to transfer the process stream from the separation tank 38 into the hydrocyclone. A pump may provide certain advantages, as it may provide a constant system flow, when compared to a batch process utilizing a transfer tank. However, a transfer tank configuration, such as shown in FIG. 1, may provide a more reliable process stream 12 flow. In yet further embodiments, a plurality of transfer tanks 40 may be utilized; optionally, a plurality of hydrocyclones 42 may also be utilized. Such a configuration may improve flow regularity of the process stream 12 through the plant 10 while maintaining a reliable flow of the process stream 12. Additionally, an accumulator (not shown) may be provided and the transfer motive gas stream 16 may be accumulated in the accumulator prior to being directed into the transfer tank 40 to facilitate an expedient transfer of the process stream 12 out of the transfer tank 40 and through the hydrocyclone 42.

In the hydrocyclone 42, a slurry including the solid $CO_2$ from the LNG process stream 12 may be directed through an underflow outlet 82 and the LNG process stream 12 may be directed through an overflow outlet 84. The LNG process stream 12 may then be directed through the filter 44, which may remove any remaining $CO_2$ or other impurities, which may be removed from the system through a filter outlet 86, such as during a cleaning process. In some embodiments, the filter 44 may comprise one screen filter or a plurality of screen filters that are placed in parallel. A substantially pure LNG process stream 12, such as substantially pure liquid $CH_4$, may then exit the filter 44 and be directed into a LNG process stream 12 and a secondary LNG stream that may form the second tail gas stream 26. The LNG process stream 12 may be directed through the valve 48 and into the storage tank 50, wherein it may be withdrawn for use through the LNG outlet 52, such as to a vehicle which is powered by LNG or into a transport vehicle.

Additionally, the $CO_2$ slurry in the hydrocyclone 42 may be directed through the underflow outlet 82 to form the $CO_2$ management stream 22 and be directed to the $CO_2$ sublimation chamber 70 to sublimate the solid $CO_2$ for removal from the plant 10. Additionally, the separation chamber vent stream 18, the transfer tank vent stream 20 and the storage tank vent stream 24 may be combined in the mixer 74 to provide a gas stream 28 that may be used to sublimate the $CO_2$ management stream 22. The gas stream 28 may be relatively cool upon exiting the mixer 74 and may be directed through a fourth channel of the primary heat exchanger 34 to extract heat from the process stream 12 in the third channel of the primary heat exchanger 34. The gas stream 28 may then be directed through the compressor 76 to further pressurize and warm the gas stream 28 prior to directing the gas stream 28 into the $CO_2$ sublimation chamber 70 to sublimate the $CO_2$ of the $CO_2$ management stream 22 from the underflow outlet 82 of the hydrocyclone 42. In some embodiments, a heat exchanger, such as described in application Ser. No. 11/855,071, filed Sep. 13, 2007, titled Heat Exchanger and Associated Method, owned by the assignee of the present invention, the disclosure thereof which is previously incorporated by reference in its entirely herein, may be utilized as the sublimation chamber 70. In further embodiments, a portion of the gas stream 28, such as an excess flow portion, may be directed out of the plant 10 through a tee (not shown) prior to being directed into the $CO_2$ sublimation chamber 70 and may provide an additional tail stream (not shown).

The combined gaseous $CO_2$ from the $CO_2$ management stream 22 and the gases from the stream 28 may then exit the sublimation chamber 70 as the first tail gas stream 30, which may be relatively cool. For example, the first tail gas stream 30 may be just above the $CO_2$ sublimation temperature upon exiting the sublimation chamber 70. The first tail gas stream 30 may then be directed through a fifth channel of the primary heat exchanger 34 to extract heat from the process stream 12 in the third channel prior to exiting the plant 10 through the first tail gas outlet 72 at a first pressure.

Finally, the second tail gas stream 26, which may initially comprise a secondary substantially pure LNG stream from the splitter 46, may be directed through the pump 78. In additional embodiments, the pump 78 may not be required and may not be included in the plant 10. For example, sufficient pressure may be imparted to the process stream 12 within the transfer tank 40 by the transfer motive gas stream 16 such that the pump 78 may not be required and may not be included in the plant 10. The second tail gas stream 26 may then be directed through a sixth channel of the primary heat exchanger 34, where it may extract heat from the process stream 12 in the third channel, and may become vaporized to form gaseous NG. The second tail stream 26 may then be directed out of the plant 10 via the second tail gas outlet 80 at a second pressure, the second pressure different than the first pressure of the first tail gas stream 30 exiting the first tail gas outlet 72.

In some embodiments, as the process stream 12 progresses through the primary heat exchanger 34, the process stream 12 may be cooled first by the cooling stream 14, which may extract about two-thirds (⅔) of the heat to be removed from the process stream 12 within the heat exchanger 34. Remaining cooling of the process stream 12 within the primary heat exchanger 34 may then be accomplished by the transfer of heat from the process stream 12 to the second tail gas stream 26. In view of this, the amount of flow that is directed into the second tail gas stream 26 may be regulated to achieve a particular amount of heat extraction from the process stream 12 within the heat exchanger 34.

In view of the foregoing, and as further described herein, the plant 10 may be utilized to liquefy natural gas in a wide variety of locations having a wide variety of supply of gas configurations. Ideal locations for natural gas liquefaction may have a high incoming gas pressure level and low downstream tail gas pipeline pressure levels having significant flow rate capacities for gas therein. However, many locations where gas liquefaction is needed do not conform to such ideal conditions of a high incoming gas pressure level and a low downstream tail gas pressure levels having significant flow rate levels of gas therein. In view of this, the invention described herein offers flexibility in the process and apparatus to take advantage of the pressure levels and flow rates of gas in pipelines at a particular location. Such may be accomplished by separating the various gas flow streams in the plant 10, as shown in FIG. 1.

Figure 2:
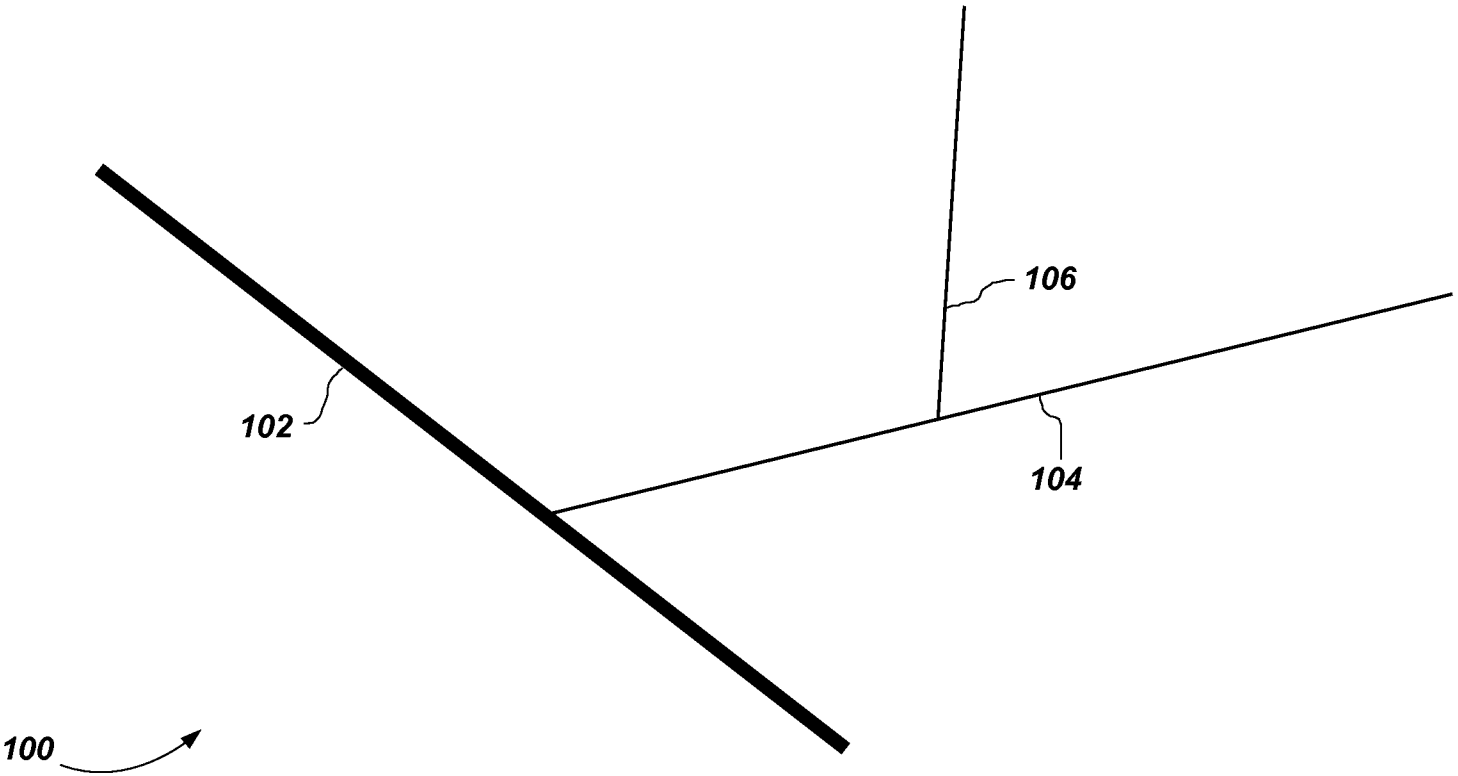
FIG. 2 is a flow diagram depicting a natural gas letdown location, such as may be utilized with liquefaction plants and methods of the present invention.

In some embodiments, the plant 10 may be utilized at a NG distribution pressure letdown location 100, as shown in FIG. 2. The letdown location 100 may include significantly different gas pressure levels, flow rate levels, and temperature levels, such as between a relatively high pressure pipeline 102, an intermediate pressure pipeline 104, and a relatively low pressure pipeline 106, that may be effectively exploited by the plant 10 and methods described herein. For a non-limiting example, the relatively high pressure pipeline 102 may have a pressure of about 800 psia, the intermediate pressure pipeline 104 may have a pressure of about 200 psia, and the relatively low pressure pipeline 106 may have a pressure of about 30 psia. The relatively high pressure pipeline 102 may be coupled to the process stream inlet 32 and provide the gaseous NG process stream 12. Additionally, the relatively high pressure pipeline 102 may coupled to the cooling fluid inlet 54 and provide gaseous NG to the cooling inlet 54 to be utilized as the cooling stream 14. The cooling fluid outlet 62 may provide the cooling stream 14 as a third tail gas stream and may be coupled to one of the intermediate pressure pipeline 104 and the relatively low pressure pipeline 106. Additionally, the transfer motive gas inlet may be coupled to one of the intermediate pressure pipeline 104 and the relatively low pressure pipeline 106.

Optionally, the cooling stream outlet 62 may be coupled to the cooling stream inlet 54 to provide a closed cooling stream loop, and any suitable relatively high pressure gas may be used, such as nitrogen or another gas.

The first tail gas outlet 72 may be coupled to one of the intermediate pressure pipeline 104 and the relatively low pressure pipeline 106 and, as the first tail gas outlet 72 and second tail gas outlet 80 are separate and may configured to provide tail gas streams 26, 30 at different pressures, the second tail gas outlet 80 may be coupled to one of the intermediate pressure pipeline 104 and the relatively low pressure pipeline 106, independent of the first tail gas outlet 72. In view of this, the first tail gas outlet 72 may be coupled to the relatively low pressure pipeline 10 while the second tail gas outlet is coupled to the intermediate pressure pipeline 104, or the first tail gas outlet may be coupled to the relatively low pressure pipeline 10 while the second tail gas outlet is coupled to the intermediate pressure pipeline 104. Each tail gas stream 14, 26, 30 may be directed into an available pipeline 102, 104, 106 at different pressures, and can be configured to release each tail gas stream 14, 26, 30 at a pressure that is economical and efficient for the specific letdown station 100 and plant 10.

The first tail gas stream 30 may contain a substantial amount of $CO_2$, and, in some embodiments, may be coupled to a $CO_2$ processing plant (not shown) as a product stream to provide a purified $CO_2$ product. For example, a $CO_2$ processing plant may be utilized to process the $CO_2$ separated from the liquid NG process stream, and may provide a substantially pure $CO_2$ as a product. In view of this, a byproduct that would normally be removed as waste could be utilized as a product stream that could be used or sold.

Furthermore, the second tail gas stream 26 may consist of substantially pure NG and may be combusted upon exit from the plant 10. In some embodiments, the second tail gas stream 26 may be combusted in a flare (not shown). In other embodiments, the second tail gas stream 26 may be combusted in an engine (not shown) to provide power to the plant 10. For example, if it would require significant energy to compress the second tail stream to a pressure of an available pipeline for removal, or if such a pipeline was unavailable, it may be economical to combust the second tail gas stream 26 in a flare. In another example, the second tail gas stream could be provided to an engine that may produce power that may be utilized to power components of the plant 10, such as one or more of the compressors 56, 76.

In additional embodiments, a portion, or all, of the second tail gas stream 26 may be redirected into the process stream 12. In some embodiments, the second tail gas stream 26 may be utilized to dilute a marginal process stream 12, which may include one or more impurities, to provide a process stream 12 with a lower percentage of impurities that may be more efficiently processed. For example, a $CO_2$ rich process stream 12 may be diluted with substantially pure NG from the second tail gas stream 26 to provide a process stream 12 composition that has a lower $CO_2$ percentage.

Similarly, the ability of the plant 10 to accommodate multiple independent input streams may also provide for greater flexibility and efficiency of the plant 10. For example, the process stream 12, cooling stream 14 and transfer motive gas stream 16 may all be fed into the plant 10 from different sources at different pressures and flows. It may be advantageous in some cases to provide the process stream 12 at a relatively high pressure, such as about 800 psia. However, it may not be particularly advantageous to provide such high pressures for other input streams, such as the transfer motive gas stream 16. For example, where a higher process stream 12 pressure may result in an improved process stream 12 efficiency, systems that utilize a single input stream necessarily require a higher input pressure for all of the input streams. However, the plant 10 may allow methods wherein only the pressure of the process stream 12 may be increased, while the other input streams 14, 16 may be input into the plant 10 at a lower pressure, reducing the amount of gas input into the plant 10 that must be compressed, thus resulting in a reduced energy requirement for the plant 10.

Optionally, the inlet streams may be additionally processed prior to being directed into the plant 10. For example, the inlet streams may be compressed or expanded to provide the input streams at a particular pressure and temperature that is different than the source pressure and temperature. For another example, one or more external dehydrators (not shown) may be used to remove water from one or more of: the gaseous NG prior to being directed into the NG inlet 32, the cooling stream 14 prior to being directed into the cooling fluid inlet 54, and the transfer motive gas stream 16 prior to being directed into the transfer fluid inlet 64.

By maintaining separate input gas streams inlets 32, 54, 64 and separate tail gas stream outlets 62, 72, 80, the plant 10 may be flexible. In other words, a single plant design may accommodate, and be relatively efficient at, a variety of source gas locations.

Another example of the flexibility of the disclosed plant 10 may be found in the arrangement of the cooling stream 14. The cooling gas for the cooling stream 14 comes into the plant through the cooling fluid inlet 54 and may then be directed through the turbo compressor 56 to increase the pressure of the cooling stream 14. The cooling stream may then be cooled, such as by the ambient heat exchanger 58 and the primary heat exchanger 34, prior to entering the turbo expander 60, where it may be expanded and cooled prior to being redirected through the primary heat exchanger 34. As previously discussed, the energy from expanding the gas in the turbo expander 60 may be utilized to power the turbo compressor 56, which may provide a power savings for the plant 10. Additionally, there is a relationship between the amount of pressure generated by the turbo compressor 56 and the amount of heat that may be withdrawn from the cooling stream 14 prior to the cooling stream 14 being directed into the turbo expander 60, and the pressure and temperature of the cooling stream 14 upon exiting the turbo expander 60. Embodiments of the present invention may exploit this relationship to provide improved efficiency, due to the ability to change the cooling stream outlet pressure to match the needed pipeline capacity of a pipeline that may be used to carry the cooling stream tail gas away from the plant 10.

As a non-limiting example, the cooling stream tail gas outlet 62 may direct the tail gas from the cooling stream 14 out of the plant 10 into an intermediate pressure pipeline 104 that requires gas at a pressure of about 200 psia and a temperature of about 50° F. When gaseous NG is utilized to provide the cooling stream 14, the temperature and pressure of the cooling stream 14 may be limited by the $CO_2$ concentration that is contained in the NG, as temperatures below a critical temperature at a particular pressure will result in a phase change of the $CO_2$. A separate cooling stream tail gas outlet 62 allows flows and pressures to be adjusted in the primary heat exchanger 34 to balance the process needs with the available cooling provided by the expander 60.

Significant energy savings may be realized by matching the turbo expander 60 outlet pressure with available tail gas pressure requirements. When a tail gas pipeline, such as the intermediate pressure tail gas pipeline 104 or the relatively low pressure tail gas pipeline 106, is not available the tail gases 62, 72, 80 from the plant 10 may need to be recompressed. In such a case, the ability to limit the pressure drop from the turbo expander 60 may be very valuable, as this may reduce the compression ratio required between the cooling stream tail gas outlet 62 and a relatively high pressure inlet, such as the relatively high pressure pipeline 102, and reduce the energy required to compress the cooling stream 14 tail gas.

Additionally, cooling for the plant 10 may come from sources other than the turbo expander 60 of the cooling stream 14, which may allow flexibility and control of the cooling stream input 54 and output 62 pressures. For example, cooling may come from the ambient heat exchanger 58, as well as from cooled streams from other areas of the plant, such as from the $CO_2$ sublimation chamber 70 and from the second tail stream 26. In additional embodiments, cooling may be obtained by including a chiller or an active refrigeration system.

In some embodiments, the plant 10 may be configured as a "small-scale" natural gas liquefaction plant 10 which is coupled to a source of natural gas such as a pipeline 102, although other sources, such as a well head, are contemplated as being equally suitable. The term "small-scale" is used to differentiate from a larger-scale plant having the capacity of producing, for example 70,000 gallons of LNG or more per day. In comparison, the presently disclosed liquefaction plant may have a capacity of producing, for example, approximately 30,000 gallons of LNG a day but may be scaled for a different output as needed and is not limited to small-scale operations or plants. Additionally, the liquefaction plant 10 of the present invention may be considerably smaller in size than a large-scale plant and may be transported from one site to another. However, the plant 10 may also be configured as a large-scale plant if desired. The plant 10 may also be relatively inexpensive to build and operate, and may be configured to require little or no operator oversight.

Furthermore, the plant 10 may be configured as a portable plant that may be moved, such as by truck, and may be configured to couple to any number of letdown stations or other NG sources.

The plant 10 and methods illustrated and described herein may include the use of any conventional apparatus and methods to remove carbon dioxide, nitrogen, oxygen, ethane, etc. from the natural gas supply before entry into the plant 10. Additionally, if the source of natural gas has little carbon dioxide, nitrogen, oxygen, ethane, etc., the use of hydrocyclones and carbon dioxide sublimation in the liquefaction process and apparatus may not be needed and, therefore, need not be included.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the scope of the invention as defined by the following appended claims.

What is claimed is:

1. A method of natural gas liquefaction, comprising:

directing a gaseous natural gas process stream comprising carbon dioxide and a cooling stream into a plant;

cooling the gaseous natural gas process stream by transferring heat from the gaseous natural gas process stream to the cooling stream;

expanding the cooled gaseous natural gas process stream to form a liquid natural gas process stream, a solid carbon dioxide portion suspended in the liquid natural gas stream, and a first tail gas stream comprising a gaseous natural gas;

separating the solid carbon dioxide portion from at least a portion of the liquid natural gas process stream to provide a substantially pure liquid natural gas;

sublimating the solid carbon dioxide;

directing the first tail gas stream out of the plant at a first pressure;

directing the sublimated carbon dioxide out of the plant in the first tail gas stream;

separating a secondary liquid natural gas stream from the liquid natural gas process stream and vaporizing the secondary liquid natural gas stream with a heat exchanger to form a second tail gas stream comprising gaseous natural gas; and directing the second tail gas stream out of the plant at a second pressure, the second pressure different than the first pressure of the first tail gas stream.

2. The method of claim 1, further comprising maintaining separation of the cooling stream from the gaseous natural gas process stream within the plant.

3. The method of claim 2, wherein directing a cooling stream into a plant further comprises directing a gaseous cooling stream into the plant having a gas composition different than a gas composition of the gaseous natural gas process stream directed into the plant.

4. The method of claim 2, wherein directing a cooling stream into a plant further comprises directing a gaseous cooling stream having a pressure different than a pressure of the gaseous natural gas process stream directed into the plant.

5. The method of claim 2, wherein directing a cooling stream into the plant comprises directing a cooling stream comprising gaseous natural gas into the plant.

6. A method of natural gas liquefaction, comprising:

directing a gaseous natural gas process stream comprising carbon dioxide and a cooling stream into a plant;

cooling the gaseous natural gas process stream by transferring heat from the gaseous natural gas process stream to the cooling stream;

expanding the cooled gaseous natural gas process stream to form a liquid natural gas process stream, a solid carbon dioxide portion suspended in the liquid natural gas process stream, and a first tail gas stream comprising a gaseous natural gas;

separating the solid carbon dioxide portion from at least a portion of the liquid natural gas process stream to provide a substantially pure liquid natural gas;

directing the solid carbon dioxide portion suspended in the liquid natural gas process stream into a transfer tank;

directing a transfer motive gas into the transfer tank to direct the solid carbon dioxide portion directing a transfer motive gas into the transfer tank to direct the solid carbon dioxide portion suspended in the liquid natural gas process stream into a hydrocyclone;

sublimating the solid carbon dioxide;

directing the first tail gas stream out of the plant at a first pressure;

directing the sublimated carbon dioxide out of the plant;

directing gases from the transfer tank out of the plant in the first tail gas stream;

separating a secondary liquid natural gas stream from the liquid natural gas process stream and vaporizing the secondary liquid natural gas stream with a heat exchanger to form a second tail gas stream comprising gaseous natural gas; and directing the second tail gas stream out of the plant at a second pressure, the second pressure different than the first pressure of the first tail gas stream.

7. The method of claim 6, wherein directing a transfer motive gas into the transfer tank comprises directing a transfer motive gas from a natural gas source having a lower pressure than a natural gas source for the gaseous natural gas process stream.

8. The method of claim 1, further comprising:

directing the liquid natural gas process stream to a storage tank to provide a substantially pure liquid natural gas to the storage tank; and wherein separating a secondary liquid natural gas stream from the liquid natural gas process stream comprises separating a secondary liquid natural gas stream consisting of substantially pure liquid natural gas from the liquid natural gas process stream.

9. The method of claim 8, wherein directing the second tail gas stream out of the plant further comprises combusting the second tail gas stream.

10. The method of claim 9, wherein combusting the second tail gas stream comprises combusting the second tail gas stream in a flare.

11. The method of claim 9, wherein combusting the second tail gas stream comprises combusting the second tail gas stream in a combustion engine.

12. The method of claim 1, further comprising directing a separate third tail gas stream out of the plant.

13. The method of claim 12, wherein directing a separate third tail gas stream out of the plant comprises directing the cooling stream out of the plant in the separate third tail gas stream.

14. The method of claim 1, wherein directing a cooling stream into the plant comprises providing a closed-loop cooling stream.

15. The method of claim 1, further comprising directing each of the gaseous natural gas process stream, the cooling stream, the first tail gas stream and the second tail gas stream through a respective channel of a multi-pass heat exchanger.

16. The method of claim 1, further comprising:

compressing the cooling stream with a compressor;

expanding the cooling stream with an expander; and powering the compressor, at least in part, with power generated by the expander.

17. The method of claim 16, further comprising extracting heat from the cooling stream with a heat exchanger after compressing the cooling stream with the compressor and prior to expanding the cooling stream with the expander.

18. The method of claim 6, wherein separating the solid carbon dioxide portion from at least a portion of the liquid natural gas process stream to provide a substantially pure liquid natural gas comprises directing the solid carbon dioxide portion through an underflow of the hydrocyclone and directing the substantially pure liquid natural gas through an overflow of the hydrocyclone.

* * * * *

UNITED STATES PATENT AND TRADEMARK OFFICE

CERTIFICATE OF CORRECTION

PATENT NO. : 8,899,074 B2
APPLICATION NO. : 12/604194
DATED : December 2, 2014
INVENTOR(S) : Bruce M. Wilding and Terry D. Turner It is certified that error appears in the above-identified patent and that said Letters Patent is hereby corrected as shown below:

In the claims:

CLAIM 6, COLUMN 13, LINES 1-2, delete repetitive lines 1 and 2 "directing a transfer motive gas into the transfer tank to direct the solid carbon dioxide portion"

Signed and Sealed this
Ninth Day of August, 2016

Michelle K. Lee

Michelle K. Lee
*Director of the United States Patent and Trademark Office*